252-99 AU 166 EX
4/11/78 OR 4,083,794

United States Patent [19]
Lee et al.
[11] 4,083,794
[45] Apr. 11, 1978

[54] DETERGENT COMPOSITION

[75] Inventors: Frank Lee, Bolton; Charles Fearnley, Romiley; Glenda Helen Fordham, Simmondley, all of England

[73] Assignee: Ciba-Geigy Corporation, Ardsley, N.Y.

[21] Appl. No.: 690,803

[22] Filed: May 27, 1976

[30] Foreign Application Priority Data

Jun. 10, 1975 United Kingdom ..... 24841/75
Jan. 10, 1976 United Kingdom ..... 939/76

[51] Int. Cl.[2] ..... C11D 7/56; C11D 7/38
[52] U.S. Cl. ..... 252/99; 252/89 R; 252/136; 252/DIG. 2; 252/DIG. 15; 252/559
[58] Field of Search ..... 252/89, 136, DIG. 2, 252/DIG. 15, 99, 559

[56] References Cited

U.S. PATENT DOCUMENTS 3,235,505 2/1966 Tuvell ..... 252/DIG. 2
3,308,067 3/1967 Diehl ..... 252/DIG. 2

*Primary Examiner*—Mayer Weinblatt
*Attorney, Agent, or Firm*—Edward McC. Roberts; Prabodh I. Almaula

[57] ABSTRACT

A soap or synthetic detergent composition is provided which comprises an anionic and/or non-ionic surfactant and (a) from 0.1 to 2.5% by weight of a compound consisting essentially of hydrolyzed polymaleic anhydride with a molecular weight of 300 to 5000 or of a water-soluble salt of such hydrolyzed polymaleic anhydride, or
(b) from 0.1 to 2.5% by weight of a hydrolyzed copolymer with a molecular weight of 300 to 1000 from 2.5 to 100, preferably 2.5 to 30 moles of maleic anhydride with 1 mole of monoethylenically unsaturated monomer or mixture of monomer.

Also a method of washing textiles, preferably cellulosics, with an aqueous bath containing 0.5 to 20 g/l of said soap or synthetic detergent composition is provided.

The deposit of scale on working parts of the washing machine employed and of residual calcium and magnesium salts onto textiles is reduced or inhibited by using said soap or synthetic detergent composition.

10 Claims, No Drawings

DETERGENT COMPOSITION

The present invention relates to detergent compositions.

The use of washing machines in areas in which the water used is hard, leads to deposition of insoluble inorganic salts on to the washed fabrics and the working parts of the machine.

A detergent composition has now been found which, when used in conjunction with hard water in a washing machine, reduces or inhibits the deposition of these undesired insoluble salts.

According to the present invention, there is provided a soap or synthetic detergent composition comprising an anionic and/or non-ionic surfactant and (a) from 0.1% to 2.5% by weight, based on the total weight of the composition, of a compound consisting essentially of hydrolysed polymaleic anhydride, as hereinafter defined, and having a molecular weight of 300 to 5000 as determined by calculation following osmometric measurement on the polymaleic anhydride before hydrolysis, or of a water-soluble salt of such hydrolysed polymaleic anhydride, or (b) from 0.1% to 2.5% by weight, based on the total weight of the composition, of a hydrolysed copolymer of maleic anhydride with a monoethylenically unsaturated monomer or mixture of monomers, the molar ratio of maleic anhydride to the total of other monomers being from 2.5:1 to 100:1, preferably from 2.5:1 to 30:1, more preferably from 2.5:1 to 7:1, and most preferably from 2.5:1 to 5:1, the molecular weight of the copolymer being at most 1000, preferably from 300 to 1000.

Polymaleic anhydride is essentially a homopolymer of maleic anhydride and may be hydrolysed very readily, for example, by heating with water, to form a polymeric product which contains free carboxylic acid groups, and possibly some residual anhydride groups, on a carbon backbone; the product is not pure polymaleic acid. The actual structure of the product is not known and so this type of polymeric product formed by hydrolysing polymaleic anhydride will be referred to in this specification as hydrolysed polymaleic anhydride.

The material referred to in this specification as hydrolysed polymaleic anhydride may be prepared from a polymer obtained by the addition polymerisation of a monomer feed comprising substantially maleic anhydride, under bulk or solution polymerisation conditions. Preferably, maleic anhydride is polymerised in a reactive solvent such as toluene or xylene in the presence of a polymerisation catalyst, more particularly of a free radical initiator such as benzoyl peroxide, di-tertiary butyl peroxide or mono-butyl hydroperoxide at temperatures of up to 150° C, e.g. 120° to 145° C. The main chain of the initial polymer is substantially formed of non-hydrolysable linkages. The initial unhydrolysed polymer product, when free from unreacted monomer and other non-polymeric molecular species, is subsequently hydrolysed with water or a water-soluble alkali, either before use, or by the act of incorporation into an aqueous application medium.

Decarboxylation of the polymer may occur during polymerisation or subsequent hydrolysis, so that the acid value of the hydrolysed polymaleic anhydride is found to be lower than the theoretical value of 956 mg KOH/g, but such decarboxylation does not proceed to such an extent that the acid value falls below 350 mg KOH/g. The acid value may be determined by potentiometric titration in aqueous solution against 0.1 N potassium hydroxide solution, the end point being taken as the highest peak on a graph plotted of $\Delta pH: \Delta V$ against V wherein $\Delta pH$ is the change of pH, $\Delta V$ is the change in volume and V is the volume of titre.

It is important that the hydrolysed polymaleic anhydride be of the stated low molecular weight range. It is preferred to use material of molecular weight not exceeding 2000, and preferably in the range 500 to 1000.

Further details of the nature of the hydrolysed polymaleic anhydride including its preparation, are described in British Pat. Nos. 1,369,429 and 1,411,063.

The ethylenically unsaturated monomers for copolymerisation with maleic anhydride may be selected from a wide range of materials, for example, acrylic acid, methacrylic acid, crotonic acid, itaconic acid or its anhydride, aconitic acid, as well as the esters of foregoing acids, e.g. ethyl acrylate and methyl methacrylate; acrylonitrile; acrylamide; vinyl acetate; styrene; α-methyl styrene; methyl vinyl ketone; acrolein; ethylene; propylene; or mixtures thereof.

When mixtures of monomers are used, the resulting polymer may be, e.g., a terpolymer such as that derived from maleic anhydride and two other monomers, e.g., vinyl acetate and ethyl acrylate.

Particularly preferred copolymers are those derived from hydrolysed copolymers of maleic anhydride and acrylic acid, its amide and its esters, methacrylic acid, its amide and its esters, and vinyl esters.

The copolymers as well as polymaleic anhydride may be prepared by polymerisation in a reactive solvent using a free radical initiator such as benzoyl peroxide, di-tertiary butyl peroxide or monobutyl hydroperoxide. The copolymer is isolated by precipitation from solution.

Examples of reactive solvents include ethyl benzene, carbon tetrachloride, acetonitrile and especially xylene and toluene.

The copolymers of maleic anhydride may be hydrolysed e.g. by means of water, alkali or mineral acid.

Further details of copolymers and their preparation are provided in British Pat. No. 1,414,918.

The soap or synthetic detergent composition may be any soap or synthetic detergent composition suitable e.g. for cleaning hard surfaces or washing textile articles. Suitable compositions are described, for instance, in the text-book "Domestic and Industrial Chemical Specialities" by L. Chalmers, in which the chapter headed "Synthetic Detergents" is of particular relevance.

The synthetic detergent composition contains a non-ionic surfactant or, preferably, an anionic surfactant. The non-ionic surfactant may fall within one of the following sub-groups:

(a) monoethers of polyglycols with long-chain fatty alcohols. For instance, the condensation product of 5 to 20 moles of ethylene oxide with a fatty alcohol having 11 to 18 carbon atoms, e.g. cetyl alcohol.

(b) monoesters of polyglycols with long-chain fatty acids. For instance, the condensation products of 5 to 20 moles of ethylene oxide with a fatty acid having 12 to 18 carbon atoms, e.g. stearic acid.

(c) monoethers of polyglycols with alkyl-phenols. For instance, the condensation products of 5 to 20 moles of ethylene oxide with an alkyl phenol having 6 to 12 carbon atoms, e.g. nonyl phenol.

(d) N,N-polyethoxylated long-chain fatty amines. For instance the condensation products of 5 to 50 moles of ethylene oxide with a fatty amine having 12 to 18 carbon atoms, e.g. cocoamine and tallow amine.

(e) N,N-polyethoxylated long-chain fatty acid amides. For instance, the condensation products of 5 to 50 moles of ethylene oxide with hydrogenated fatty acid amides having 12 to 18 carbon atoms, e.g. tallow amide.

The preferred anionic surfactants are, in particular, alkali metal or ammonium salts of fatty carboxylates, sulphates or sulphonates. Suitable examples are alkali metal stearates, alkali metal alkyl sulphates e.g. sodium dodecyl sulphate, alkali metal alkyl sulphonates e.g. potassium dodecyl sulphonate, alkali metal alkaryl sulphonates e.g. sodium dodecyl benzene sulphonate, fatty acid sarcosinates, sulphonated alkyl esters of long chain fatty acids and alkyl sulphosuccinates.

The proportion of surfactant in the synthetic detergent composition is normally up to 40% by weight, most commonly from 10% to 30% by weight, based on the total weight of the composition.

Further components which are usually included in synthetic detergent compositions are builders, bleaching agents, dirt-suspending agents, optical brightening agents, enzymes and mild perfumes.

Suitable builders are one or more of water soluble alkali metal salts, e.g. carbonates, borates, phosphates, polyphosphates, bicarbonates and silicates. Examples of such salts are sodium tripolyphosphate sodium carbonate, sodium tetraborate, sodium pyrophosphate, potassium polyphosphate, sodium bicarbonate and sodium silicate. Other suitable builders are water-soluble alkali metal or ammonium sequestrant salts, e.g. sodium, potassium and ammonium ethylene diamine tetraacetates. Preferred bleaching agents include alkali metal per-carbonates and per-sulphates, more preferably alkali metal per-borates. A suitable dirt-suspending agent is carboxymethyl cellulose. As optical brighteners, there may be used these following types: triazinyl-diamino-stilbene disulphonic acids, aminocoumarins, pyrazolines, stilbene naphthotriazoles, benzoxazoles, imidazolones, benzidine sulphone bisoxazoles, distyryl diphenyls, dibenzimidazoles or derivatives thereof. Enzymes which may conveniently be used are those containing predominantly a protease produced from a spore-forming Bacillus subtilis bacterium. A suitable perfume is one having a citrus, cologne or pine base.

Soap or detergents in solid form may, therefore, contain components e.g. bleaching agents or phosphate or carbonate builders which are aggressive towards metallic surfaces. Such components of soaps or detergents can aggravate the problem of hard scale formation in washing machines and the compositions of the present invention cope particularly well with the problems presented by such aggressive systems.

According to the present invention, there is also provided a method of washing textile articles comprising treating the articles in an aqueous bath containing a detergent composition of the invention, as hereinbefore defined.

The concentration of the detergent composition is preferably within the range of from 0.5 to 20 g/l, more preferably within the range of from 2 to 10 g/l of the total bath. The treatment temperature is desirably within the range of from 25° to 98° C.

Since polymaleic anhydride and the copolymers of maleic anhydride are readily hydrolysed, a method of washing textile articles with a soap or detergent containing polymaleic anhydride or an un-hydrolysed copolymer of maleic anhydride results in the same washing medium as that starting from a soap or detergent containing the hydrolysed polymaleic anhydride or a hydrolysed copolymer.

Therefore, in a modification of the method of the invention, textile articles are washed with a soap or detergent composition containing sufficient amount of polymaleic anhydride or maleic anhydride copolymer to provide the equivalent weight concentration of hydrolysed polymaleic anhydride or copolymer of maleic anhydride.

In a less preferred modification of the method according to the present invention, the soap or detergent base and the hydrolysed polymaleic anhydride or the hydrolysed copolymer of maleic anhydride may be added separately to the wash.

Both natural and synthetic textile fabrics respond favourably to washing according to the process of the present invention.

However, cellulosics benefit particularly by washing according to the method of this invention.

The deposition of residual calcium and magnesium salts onto textile articles washed according to the method of the present invention is reduced or inhibited, resulting in a softer handle being imparted to the washed articles. Moreover, the level of deposit of scale on the working parts of the washing machine employed in carrying out the method of the present invention was much less than that obtained when using conventional soaps and detergents.

The following Examples further illustrate the present invention. Parts and percentages shown therein are by weight.

EXAMPLE 1

A wash liquor was made up containing 5 g/l of the following solid detergent composition:

20% dodecylbenzene sulphonate
35% sodium tripolyphosphate
20% sodium perborate
10% sodium silicate
10.5% sodium sulphate
2% carboxymethyl cellulose
2.5% hydrolysed maleic anhydride copolymer The hydrolysed maleic anhydride copolymer was produced as follows:

(a) 294 parts of maleic anhydride dissolved in 300 parts of xylene were heated to reflux temperature with stirring. A solution comprising:

43 parts of vinyl acetate
50 parts of ethyl acrylate
5 parts of ditertiarybutyl peroxide and
150 parts of xylene was maintained at 20° C and added over a 2 hour period to the refluxing maleic anhydride solution. Stirring and refluxing was continued for a further 4 hours. The temperature was reduced to 120° C and the lower resin layer was transferred to a separate vessel containing water at 80° C. The resin and water were stirred and residual xylene removed by distillation. During this part of the process, the resin dissolved.

(b) Sufficient 50% sodium hydroxide solution was added to raise the pH of the resin solution to 10. The temperature was maintained at 80°-90° C for 2 hours. During this time, more sodium hydroxide solution was added to maintain the pH at 10. After cooling to 20° C, the solids content was adjusted to 50% weight solids calculated on weight of solution.

When mercerized cotton sateen was washed in the above wash liquor using hard water, the washed fabric was found to have a softer feel and to contain less insoluble calcium and magnesium salts than a control washed with a liquor containing no hydrolysed copolymer of maleic anhydride.

EXAMPLES 2 to 21

Similar results were obtained when the hydrolysed maleic anhydride copolymer described above was replaced by the equivalent amount of a copolymer produced according to the reaction conditions described in the following Table.

TABLE

| Ex. No. | Moles of maleic anhydride | Moles of First monomer | Moles of second monomer | Solvent |
|---|---|---|---|---|
| 2 | 2.5 | 0.5 ethyl acrylate | 0.5 vinyl acetate | toluene |
| 3 | 9.0 | 1.0 ethyl acrylate | 2.0 vinyl acetate | xylene |
| 4 | 10.0 | 1.0 ethyl acrylate | — | toluene |
| 5 | 3.0 | 1.0 vinyl acetate | — | ethyl benzene |
| 6 | 6.0 | 1.0 vinyl acetate | 1.0 ethyl acrylate | xylene |
| 7 | 29.0 | 1.0 vinyl acetate | — | toluene |
| 8 | 2.5 | 1.0 ethylene | — | toluene |
| 9 | 2.5 | 1.0 propylene | — | xylene |
| 10 | 3.0 | 0.5 methyl vinyl ketone | 0.5 vinyl acetate | toluene |
| 11 | 14.0 | 1.0 methyl vinyl ketone | — | toluene |
| 12 | 3.0 | 1.0 methyl methacrylate | — | toluene |
| 13 | 6.0 | 1.0 methyl methacrylate | 1.0 ethyl acrylate | xylene |
| 14 | 3.0 | 0.5 acrylonitrile | 0.5 vinyl acetate | ethyl benzene |
| 15 | 10.0 | 1.0 acrylonitrile | — | ethyl benzene |
| 16 | 14.0 | 1.0 acrolein | — | toluene |
| 17 | 3.0 | 1.0 acrylamide | — | toluene |
| 18 | 9.0 | 1.0 acrylamide | 2.0 vinyl acetate | xylene |
| 19 | 3.0 | 0.5 crotonic acid | 0.5 vinyl acetate | carbon tetrachloride |
| 20 | 7.0 | 1.0 crotonic acid | — | toluene |
| 21 | 29.0 | 1.0 styrene | — | toluene |

EXAMPLE 22

A control wash liquor was made up containing 5 g/l of the following solid detergent composition:

20% dodecylbenzene sulphonate
35% sodium tripolyphosphate
20% sodium perborate
10% sodium silicate
13% sodium sulphate
2% carboxymethyl cellulose Further washing liquors were made up by adding 0.1%, 1.0% or 2.5% of hydrolysed polymaleic anhydride.

The hydrolysed polymaleic anhydride was produced as follows:

100 parts maleic anhydride and
100 parts commercial grade xylene were heated to 120° C. A solution of 20 parts di-tertiary butyl peroxide in
50 parts commercial grade xylene were added over a period of 15 minutes. The temperature of the reaction mixture was then raised to 130° C and maintained there for 5 hours. Both heating and stirring were stopped and the polymer allowed to separate from the xylene. When the temperature of the reaction mixture had dropped to 85° C, the lower polymer layer was separated from the upper xylene layer. 81 parts (81% yield, based on fed maleic anhydride) of polymer were obtained.

The polymer was further purified by adding 15 parts 2-butanone or 1,4-dioxan as a diluent. The polymer was precipitated by adding the polymer solution to 430 parts of toluene which was stirred on a high speed homogeniser. After filtration and drying under vacuum at 50° C., 78 parts (78% yield based on fed maleic anhydride) of polymer were obtained as a cream coloured powder.

The polymer obtained above had a molecular weight of 580 when measured in 2-butanone by a vapour pressure osmometer.

For the purposes of comparison, washing liquors were made up by adding 0.1%, 1.0% or 2.5% of an ethyl acrylate/vinyl acetate/maleic acid terpolymer.

Mercerized cotton sateen patterns were washed in each of the respective washing liquors, using the following washing conditions:

| | |
|---|---|
| Washing period | 15 minutes |
| Temperature | 60° C |
| Liquor ratio | 20:1 |
| Water hardness | 300 ppm $CaCO_3$ |
| Rinse | cold water/300 ppm $CaCO_3$ |
| Number washes | 25 × |

After drying and conditioning, the washed patterns were assessed for softness by a panel of seven people using the "paired comparison" method. (James McCartney Int. Dyer & Text. Printer Aug. 19, 1966, p266–269).

Analysis of the washed patterns was undertaken using titration and atomic spectroscopic methods and the total calcium and magnesium contents of the patterns were determined.

The results obtained are set out in the following Tables I and II:

TABLE I

| | POLYELECTROLYTES | | | | | | | | | | | | | | | | | | | |
|---|---|---|---|---|---|---|---|---|---|---|---|---|---|---|---|---|---|---|---|---|
| | 0.1% HPMA | | 1.0% HPMA | | 2.5% HPMA | | 0.1% EVMT | | 1.0% EVMT | | 2.5% EVMT | | Control Detergent | | Row total | Rows-columns |
| 0.1% HPMA | | | 11 | 1 | 111 | 3 | 11 | 1 | 11 | 1 | 111 | 3 | 11 | 1 | 10 | −42 |
| 1.0% HPMA | 11111 | 10 | | | 11 | 1 | 1111 | 6 | 11111 | 10 | 111 | 3 | 11111 | 10 | 40 | 18 |
| 2.5% HPMA | 1111 | 6 | 11111 | 10 | | | 111 | 3 | 1111 | 6 | 11111 | 10 | 1111 | 6 | 41 | 24 |
| 0.1% EMVT | 11111 | 10 | 111 | 3 | 1111 | 6 | | | 11111 | 10 | 111 | 3 | 111 | 3 | 42 | 24 |
| 1.0% EMVT | 11111 | 10 | 11 | 1 | 111 | 3 | 11 | 1 | | | 111 | 3 | 1111 | 6 | 21 | −18 |
| 2.5% EMVT | 1111 | 6 | 1111 | 1 | 11 | 1 | 1111 | 6 | 1111 | 6 | | | | | 31 | 6 |
| Control Deter- | 11111 | 10 | 11 | 1 | 111 | 3 | 11 | 1 | 1111 | 6 | 111 | 3 | | | 24 | −12 |

TABLE I-continued

| | POLYELECTROLYTES | | | | | | | | |
|---|---|---|---|---|---|---|---|---|---|
| | 0.1% HPMA | 1.0% HPMA | 2.5% HPMA | 0.1% EVMT | 1.0% EVMT | 2.5% EVMT | Control Detergent | Row total | Rows-columns |
| gent Column Total | 52 | 22 | 17 | 18 | 39 | 25 | 36 | 209 | 0 |

HPMA = hydrolysed polymaleic anhydride
EVMT = ethyl acrylate/vinyl acetate/maleic acid terpolymer
The above results indicate that the patterns washed with detergents containing 2.5% and 1% HPMA were considerably softer than those washed with detergent alone. The results given by 0.1% EVMT were considered anomalous.

TABLE II

2. Analysis for calcium and magnesium

| Detergent | Total hardness by titration (ppm) | Total hardness by atomic spectroscopy (ppm) | Average total hardness (ppm) |
|---|---|---|---|
| Control | 681 | — | — |
| Detergent + 0.1% HPMA | 487 | 307 | 397 |
| Detergent + 1.0% HPMA | 360 | 337 | 348 |
| Detergent + 2.5% HPMA | 314 | 270 | 292 |
| Detergent + 0.1% EVMT | 608 | 515 | 561 |
| Detergent + 1.0% EVMT | 623 | 530 | 576 |
| Detergent + 2.5% EVMT | 607 | 520 | 563 |

EXAMPLE 23

Cotton sateen patterns from Examples 1 and 22 were examined for their resistance to abrasion using a "Ring Wear" apparatus (manufacturer: Baskerville and Lindsay, U.K.). The apparatus consists of a lower, fixed cylinder on the upper surface of which is placed a ring of the material under test. An upper cylinder, rotatable by a pulley and having a ring of standard wool fabric fixed to its lower face is then lowered so that the faces of the respective cylinder come into contact. The upper cylinder is then rotated. The number or revolutions of the upper cylinder required to cause a first break in the warp and weft threads respectively, of the material under test are noted.

The results obtained are set out below:

| Wash liquor used for 25 successive wash/rinse/dry cycles in water of 300 ppm $CaCO_3$ hardness. | Number of revolutions | |
|---|---|---|
| | weft | warp |
| control detergent of Example 1 (5g/l) | 400 | 692 |
| control detergent of Example 1 (5g/l) + 0.1% EVMT | 546 | 792 |
| control detergent + 1% EVMT | 547 | 771 |
| control detergent + 2.5% EVMT | 533 | 786 |
| control detergent + 0.1% HPMA | 482 | 844 |
| control detergent + 1.0% HPMA | 535 | 800 |
| control detergent + 2.5% HPMA | 492 | 889 |

What we claim is:

1. A soap or synthetic detergent composition consisting essentially of an anionic surfactant selected from the group consisting of sodium dodecyl sulphate, potassium dodecyl sulphonate, or sodium dodecyl benzene sulphonate and/or non-ionic surface selected from the group consisting of condensation products of 5 to 20 moles of ethylene oxide with a fatty alcohol having 11 to 18 carbon atoms, condensation products of 5 to 20 moles of ethylene oxide with a fatty acid having 12 to 18 carbon atoms, condensation products of 5 to 20 moles of ethylene oxide with an alkyl phenol having 6 to 12 carbon atoms, condensation products of 5 to 50 moles of ethylene oxide with a fatty amine having 12 to 18 carbon atoms or condensation products of 5 to 50 moles of ethylene oxide with hydrogenated fatty acid amides having 12 to 18 carbon atoms and 0.1% by weight, based on the total weight of the composition, of a compound consisting essentially of hydrolysed polymaleic anhydride having a molecular weight of 300 to 5,000 as determined by calculations following osmometric measurement on the polymaleic anhydride before hydrolysis, or of a water-soluble salt of such hydrolysed polymaleic anhydride in order to inhibit scale deposition, the content of the surfactant being from 10% to 30% by weight, based on the total weight of the composition.

2. A composition as claimed in claim 1 in which the hydrolysed polymaleic anhydride has a molecular weight in the range of 500 to 1000.

3. A composition as claimed in claim 1 in which the hydrolysed polymaleic anhydride have been prepared by polymerisation in a reactive solvent using a free radical initiator.

4. A composition as claimed in claim 1 in which the hydrolyzed polymaleic anhydride have been prepared by polymerisation using benzoyl peroxide, di-tertiary butyl peroxide or monobutyl hydroperoxide as free radical initiator in xylene or toluene as reactive solvent.

5. A composition as claimed in claim 1 in which there is also present one or more of a builder selected from the group consisting of sodium tripolyphosphate, sodium carbonate, sodium tetraborate, sodium pyrophosphate, potassium polyphosphate, sodium bicarbonate, sodium silicate, or sodium, potassium and ammonium ethylene diamine tetraacetates, a bleaching agent selected from the group consisting of alkali metal per-carbonates, alkali metal per-sulphates, or alkali metal per-borates, a carboxy-methyl cellulose as a dirt-suspending agent, an optical brightening agent selected from the group consisting of triazinyl-diaminostilbene disulphonic acids, aminocoumarins, pyrazolines, stilbene naphthotriazoles, benzoxazoles, imidazolones, benzidine sulphone bisoxazoles, distyryl diphenyls or dibenzimidazoles, an enzyme containing predominantly a protease produced from a spore-forming bacillus subtilis bacterium and a mild perfume having a citrus, cologne or pine base.

6. A method of washing textile articles comprising treating the articles in an aqueous bath comprising a composition as claimed in claim 1.

7. A method as claimed in claim 6 in which the concentration of the detergent composition is within the range of 0.5 to 20 g/l of the total bath.

8. A method as claimed in claim 6 in which the textile article is a cellulosic.

9. An aqueous wash liquor containing 5g/l of solid detergent composition consisting essentially of 20% dodecylbenzene sulphonate, 35% sodium tripolyphosphate, 20% sodium perborate, 10% sodium silicate, 13% sodium sulphate, 2% carboxymethyl cellulose and 0.1% of hydrolysed polymaleic anhydride.

10. An aqueous wash liquor of claim 9, which contains 1.0% of hydrolysed polymaleic anhydride.

* * * * *